US008155863B2

(12) United States Patent
Hsu et al.

(10) Patent No.: US 8,155,863 B2
(45) Date of Patent: Apr. 10, 2012

(54) PROCESS AND DEVICE FOR CONTROLLING AN INTERNAL COMBUSTION ENGINE

(75) Inventors: Kia Hsu, Regensburg (DE); Dirk Schneider, Pfaffenhofen (DE)

(73) Assignee: Continental Automotive GmbH, Hannover (DE)

( * ) Notice: Subject to any disclaimer, the term of this patent is extended or adjusted under 35 U.S.C. 154(b) by 1051 days.

(21) Appl. No.: 12/067,207

(22) PCT Filed: Sep. 4, 2006

(86) PCT No.: PCT/EP2006/065948

§ 371 (c)(1),
(2), (4) Date: Mar. 18, 2008

(87) PCT Pub. No.: WO2007/036411

PCT Pub. Date: Apr. 5, 2007

(65) Prior Publication Data

US 2008/0255751 A1 Oct. 16, 2008

(30) Foreign Application Priority Data

Sep. 29, 2005 (DE) ..... 10 2005 046 751

(51) Int. Cl.
*F02D 41/04* (2006.01)
*F02D 41/30* (2006.01)

(52) U.S. Cl. ..... 701/104; 701/103

(58) Field of Classification Search ..... 701/103, 701/104

See application file for complete search history.

(56) References Cited

U.S. PATENT DOCUMENTS

| | | | | |
|---|---|---|---|---|
| 6,142,117 | A * | 11/2000 | Hori et al. | 123/568.21 |
| 6,298,835 | B1 * | 10/2001 | Horie et al. | 123/568.21 |
| 6,386,174 | B1 * | 5/2002 | Volz et al. | 123/295 |
| 6,623,401 | B2 * | 9/2003 | Idogawa et al. | 123/295 |
| 6,631,704 | B2 * | 10/2003 | Ogawa et al. | 123/295 |
| 7,762,244 | B2 * | 7/2010 | Aliakbarzadeh | 123/568.11 |
| 7,769,525 | B2 * | 8/2010 | Kakuya et al. | 701/103 |
| 2003/0168036 | A1 | 9/2003 | Kustosch et al. | 123/295 |
| 2005/0065706 | A1 * | 3/2005 | Gray | 701/103 |
| 2005/0161017 | A1 * | 7/2005 | Warlick | 123/275 |
| 2005/0211218 | A1 * | 9/2005 | Liu et al. | 123/299 |
| 2008/0257306 | A1 * | 10/2008 | Chen et al. | 123/350 |
| 2008/0262695 | A1 * | 10/2008 | Gibson et al. | 701/102 |
| 2008/0264380 | A1 * | 10/2008 | Kang et al. | 123/295 |
| 2008/0294325 | A1 * | 11/2008 | Kurotani et al. | 701/102 |

FOREIGN PATENT DOCUMENTS

| | | | |
|---|---|---|---|
| DE | 199 31 826 | A1 | 1/2001 |
| EP | 0 924 419 | A2 | 6/1999 |
| EP | 1 081 363 | B1 | 3/2001 |
| WO | WO 00/09878 | A2 | 2/2000 |
| WO | WO 02/12700 | A | 2/2002 |
| WO | WO 2004/055351 | A | 7/2004 |

* cited by examiner

*Primary Examiner* — Stephen K Cronin
*Assistant Examiner* — Arnold Castro
(74) *Attorney, Agent, or Firm* — King & Spalding L.L.P.

(57) ABSTRACT

In a process for controlling an internal combustion engine (10) having at least one cylinder (Z1 to Z4) in which a combustion chamber (13) is formed, fuel is injected in at least two modes of operation. The process has the following steps: relative to an operating point determined by at least one operating variable (100), an operating mode quality value is calculated for each of at least two operating modes, an operating mode (OPMOD_SEL) is selected from the at least two operating modes depending on the operating mode quality values, and correcting variables are determined and set depending on the at least one operating variable (100) and the selected operating mode (OPMOD_SEL).

16 Claims, 7 Drawing Sheets

PROCESS AND DEVICE FOR CONTROLLING AN INTERNAL COMBUSTION ENGINE

CROSS-REFERENCE TO RELATED APPLICATIONS

This application is a U.S. national stage application of International Application No. PCT/EP2006/065948 filed Sep. 4, 2006, which designates the United States of America, and claims priority to German application number 10 2005 046 751.2 filed Sep. 29, 2005, the contents of which are hereby incorporated by reference in their entirety.

TECHNICAL FIELD

The invention relates to a method and device for controlling an internal combustion engine.

BACKGROUND

Increasingly high demands are being made on internal combustion engines concerning their achievement and efficiency. At the same time, the emissions must also be kept low due to strict laws. Such requirements can be well-fulfilled if fuel is injected into a combustion chamber of the internal combustion engine in at least two modes of operation, with a switch able to be made between the two modes of operation. The invention likewise relates to an appropriate device for such an internal combustion engine.

Fuel can be injected into internal combustion engines for example with homogeneous operation or with shift operation into the combustion chamber of the internal combustion engine.

With homogenous operation, the fuel is predominantly injected during the intake phase into the combustion chamber of the internal combustion engine and for this reason still swirled to a large extent up to the ignition of the fuel, which leads to a largely homogeneous air/fuel mixture. Homogenous operation is preferably intended for the full-load operation of the internal combustion engine.

With shift operation the fuel is predominantly brought into the combustion chamber during the compression phase. This produces a layering of the fuel in the combustion chamber with the ignition of the fuel. Shift operation is mainly suitable during idling and partial load operation.

In addition to homogeneous operation or shift operation there are still different intermediate forms between these two modes of operation or the appropriate modes of operation combined with single injection or multiple injection.

From EP 1 081 363 B1, a method to control an internal combustion engine is known in which an operating mode characteristic field is adapted depending on the operating parameters of the internal combustion engine.

From the article "Effiziente Motorapplikation mit lokal linearen neuronalen Netzen" (MTZ 5/2003, Jahrgang 64, S.406-13) ["*Efficient engine application with locally linear neuronal networks*" (MTZ 5/2003, volume 64, pages 406-413)], a method for the application of control unit functions, in particular for the application in the case of engines is known.

SUMMARY

A method and device for controlling an internal combustion engine which makes possible good operation of the internal combustion engine can be provided. According to an embodiment, a method for controlling an internal combustion engine having at least one cylinder, in which a combustion chamber is embodied into which fuel is injected in at least two modes of operation, may have the following steps: a) relative to an operating point determined by at least one operating variable, calculating an operating mode quality value for each of at least two operating modes, b) depending on the operating mode quality values, selecting a mode of operation from the at least two modes of operation, and c) determining and setting correcting variables depending on the at least one operating variable and the selected mode of operation.

According to another embodiment, a device for controlling an internal combustion engine may comprise at least one cylinder, in which a combustion chamber is formed, into which fuel is injected in at least two modes of operation, wherein the device is operable to a) calculate an operating mode quality value for each of at least two modes of operation relative to an operating point determined by at least one operating variable select a mode of operation from the at least two modes of operation depending on the operating mode quality values, and to c) determine and set correcting variables depending on the at least one operating variable and the selected mode of operation.

According to further embodiments, for the at least two modes of operation depending on the operating variables, setpoint variables can be determined in each case and depending on the setpoint variables the operating mode quality value is calculated in each case. According to yet a further embodiment, for at least two modes of operation depending on the operating variables, partial operating mode quality values can be determined in each case and depending on the partial operating mode quality values, the operating mode quality value is determined by means of a cost function. According to yet a further embodiment, the setpoint variables may comprise first setpoint variables, which, for the purpose of calculating the specific operating mode quality value on the basis of the first initial setpoint variables at a start time up to the first final setpoint variables at an end time, follow a given time-dependent function, with the first initial setpoint variables and the first final setpoint variables being determined if, in the start time, a change in the operating variables takes place, and with the first initial setpoint variables being determined depending on the first setpoint variables applicable to the start time and the first final setpoint variables depending on the operating variables. According to yet a further embodiment, the given time-dependent function can be linearly time-dependent. According to yet a further embodiment, the setpoint variables can be selected from the group consisting of a rotational speed setpoint value, a fresh gas mass flow setpoint value, an ignition angle setpoint value, a camshaft phasing setpoint value, an injection phasing setpoint value, an air/fuel ratio setpoint value, a valve lift setpoint value, an overlapping setpoint value VO_SP, a charge movement flap position setpoint value, an exhaust gas recirculating rate setpoint value and a cylinder masking setpoint value. According to yet a further embodiment, the partial operating mode quality values can be selected from the group consisting of a relative fuel consumption, a relative engine noise, a relative dynamic behavior, a relative exhaust gas emission and a relative noise level. According to yet a further embodiment, the determination of the partial operating mode quality values may take place depending on the setpoint variables by means of using characteristic diagrams. According to yet a further embodiment, the determination of the partial operating mode quality values may take place depending on the setpoint variables by means of using neuronal networks. According to yet a further embodiment, a change in the mode of operation may only be permitted within given time intervals. According to yet a further embodiment, the selection of the mode of operation may take place depending on a minimum amount of a change in the operating mode quality value since a preceding selection of the mode of operation, so that the number of steps is limited to the selection of the mode of operation in a fixed period.

BRIEF DESCRIPTION OF THE DRAWINGS

The invention is described in more detail below with reference to the exemplary embodiments specified in the figures. They are as follows.

Elements with the same design or function are labeled in all the figures with the same reference symbols.

DETAILED DESCRIPTION

Figure 1:
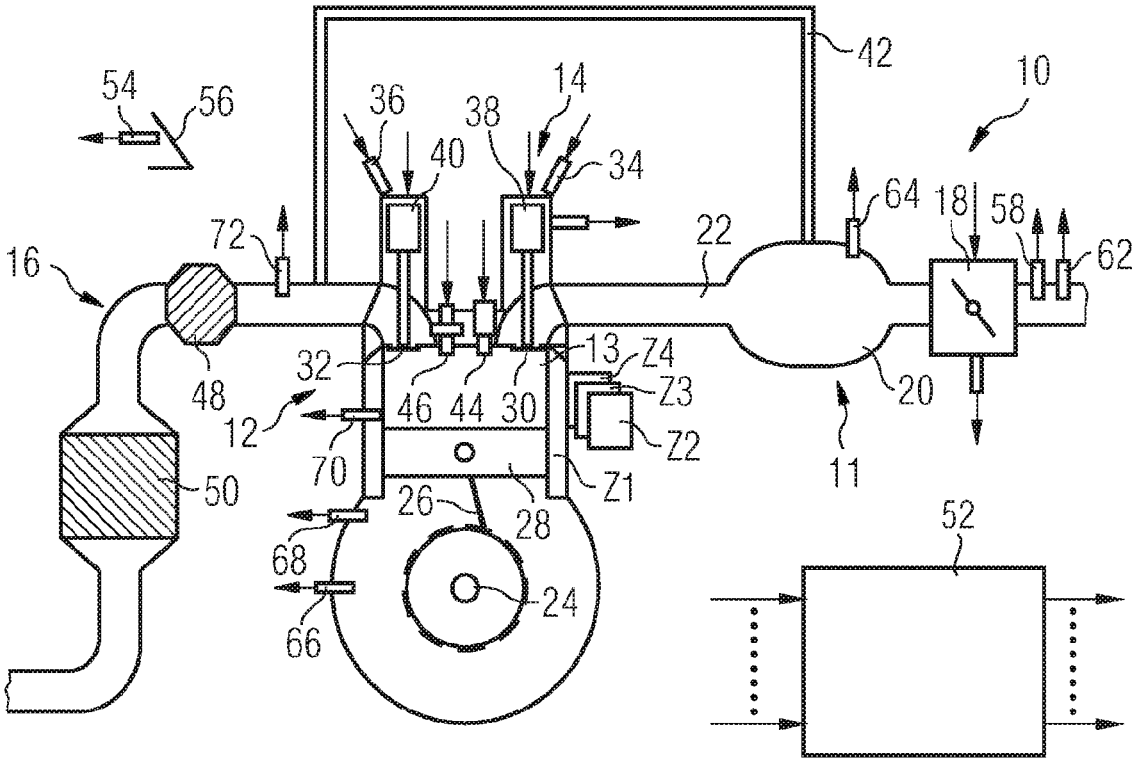
FIG. 1 an internal combustion engine with a control device.

According to various embodiments, a method and an appropriate device for controlling an internal combustion engine have at least one cylinder, in which a combustion chamber is formed into which fuel is injected in at least two modes of operation. For each of at least two modes of operation, relative to an operating point determined by at least one operating variable, an operating mode quality value is calculated. Depending on the operating mode quality value, a mode of operation is selected from the at least two modes of operation. Depending on the at least one operating variable and the selected mode of operation, correcting variables are determined and set.

In the case of internal combustion engines, different operating variables are determined. Operating variables are measured variables or variables derived therefrom. These are for example the number of revolutions, the clutch torque requirement of the driver as well as different negative and positive torque lead requirements. It is of no significance whether the operating variables are detected directly by a sensor or whether they are detected from other measured variables and characteristics or characteristic diagram values.

It is preferred that a number of operating variables be used for the determination of the operating mode quality value, which represents a quality measure for each mode of operation. The mode of operation selected dependent on the operating mode quality value is in this method determined with due consideration of preferably a plurality of relevant requirements affecting the operating point. The operating mode quality values make a clear, explicit and verifiable mode of operation selection possible.

According to an embodiment, for the at least two modes of operation, depending on the operating variables, setpoint variables are determined in each case and depending on the setpoint variables, the operating mode quality values are calculated in each case. The setpoint variables can be determined particularly simply by means of known relations from the operating variables and thus the specific operating mode quality value can also be determined in a simple manner, on the assumption that the setpoint variables are also actually set in such a way if the specific mode of operation is selected.

According to an embodiment, for at least two modes of operation depending on the operating variables, partial operating mode quality values are determined and depending on the partial operating mode quality values by means of a cost function, the operating mode quality value is determined. The partial operating mode quality values can be determined in a particularly simple way by means of known relations from the operating variables. By the determination of the operating mode quality value from the partial operating mode quality values by means of the cost function, which can be adapted in a customized manner, the mode of operation can be selected clearly and verifiably.

According to an embodiment, the setpoint variables feature first setpoint variables which, for the purpose of the calculation of the specific operating mode quality value on the basis of the first initial setpoint variable at a start time up to the first final setpoint variables at an end time, follow a given time-dependent function, with the first initial setpoint variables and the first final setpoint variables being determined if at the start time a change in the operating variables takes place, and with the first initial setpoint variables being determined depending on the first setpoint variables applicable at the start time and the first final setpoint variables depending on the operating variables.

The first setpoint variables can actually only be set according to a given time-dependent function, with the first initial setpoint variables and the first final setpoint variables only being changed over with a change in the relevant operating variables to new first initial setpoint variables and new first final setpoint variables. For this reason, the first setpoint variables go through a given range from the first initial setpoint variables up to the first final setpoint variables for the purpose of the calculation of the specific operating mode quality value as long as no change in the relevant operating variables takes place. This has the advantage that a good prediction of the operating mode quality values is possible.

According to an embodiment, the given time-dependent function is linear time-dependent. This has the advantage that a particularly simple calculation of the setpoint variables as well as a good prediction of the quality values is possible.

According to an embodiment, the setpoint variables from the group of a rotational speed setpoint value, a fresh gas mass flow setpoint value, an ignition angle setpoint value, a camshaft phasing setpoint value, an injection phasing setpoint value, an air/fuel ratio setpoint value, a valve lift setpoint value, an overlapping setpoint value, a charge movement flap position setpoint value, an exhaust gas recirculating rate setpoint value and a cylinder masking setpoint value are selected.

In a further particularly advantageous embodiment, the partial operating mode quality values from the group of a relative fuel consumption, a relative engine noise, a relative dynamic behavior, a relative exhaust gas emission and a relative noise level are selected. These variables are particularly relevant for the determination of operating mode quality values, since they permit statements either about the quality of the traveling comfort of a motor vehicle or its economic or ecological qualities.

It is particularly advantageous if the determination of the partial operating mode quality values takes place depending on the setpoint variables by means of using a characteristic diagram. This is a particularly simple method for the determination of the partial operating mode quality values.

In a further preferred embodiment, the partial operating mode quality values are determined as a function of the setpoint variables by using neuronal networks. Methods using neuronal networks can be highly efficient for determining partial operating mode quality values.

In a further particularly advantageous embodiment, a change in the mode of operation is only permitted within given time intervals. This makes possible a reduction of the number of procedures for switching between the modes of operation and thus a smoothing of the time-dependent mode of operation method by means of a wait loop.

In a further particularly preferred embodiment, the mode of operation is selected as a function of a minimum amount of a change in the operating mode quality value since a preceding selection of the mode of operation, so that the number of steps is limited for the selection of the mode of operation in a fixed period. This has the advantage that the number of procedures is reduced for switching between the modes of operation and for this reason a smoothing of the time-dependent mode of operation method is made by means of a hysteresis curve.

An internal combustion engine 10 comprises an intake tract 11, an engine block 12, a cylinder head 14, and an exhaust gas tract 16. The intake tract 11 preferably comprises a throttle valve 18, a manifold 20 and an intake pipe 22, which is guided to a cylinder Z1 via an intake port into a combustion chamber 13 in an engine block 12. The engine block 12 also comprises a crankshaft 24 that is connected to piston 28 of a cylinder Z1 by means of a connecting rod 26.

The cylinder head 14 comprises valve trains 34, 36, to which a gas intake valve 30 or a gas exhaust valve 32 are assigned in each case. Moreover, phase adjusting devices 38, 40 are assigned to the valve trains 34, 36 and preferably in each case to the gas intake valve 30 and if necessary also to the gas exhaust valve 32, by means of which a phase of the gas inlet valve lift method or the gas exhaust valve lift method can be adjusted, which is related to one point of reference concerning the crankshaft in a given position of the crankshaft. In addition, provision has also been made for an external recycling of exhaust gases 42. In addition, provision can also at least be made for a (not represented) charge movement flap for the influencing of the fluid flow into the combustion chamber 13 of the cylinder Z1.

The cylinder head 14 also includes both an injection valve 44 and a spark plug 46. Alternately, the injection valve 44 can also be arranged in the intake pipe 22.

Both an exhaust gas catalytic converter 48 and an NOx-accumulator catalytic converter 50 are arranged in the exhaust gas tract 16, the former catalytic converter preferably being embodied as a three-way catalytic converter.

In addition, a control device 52 is provided to which sensors have been assigned, said sensors detecting the different measured variables and in each case determining the value of the measured variables. The measured variables and the variables deduced from the measured variables together form the operating variables. The control device 52 determines, in accordance with at least one of the measured variables, the correcting variables, which are then converted into one or several adjusting signals for controlling the final control elements by means of corresponding actuators. The control device 52 can also be referred to as a device for the operation of an internal combustion engine.

The sensors are a pedal position indicator 54 which detects the position of an acceleration pedal 56, an air mass flow sensor 58 which detects an air mass flow upstream of the throttle valve 18, a first temperature sensor 62 which detects an intake air temperature, an intake pipe pressure sensor 64 which detects the intake pipe pressure in a manifold 20, a crankshaft angle sensor 66 which detects a crankshaft angle to which a rotational speed is allocated. Furthermore, provision is preferably made for a second temperature sensor 68, which detects a coolant temperature. Provision has been made for a cylinder pressure sensor 70, which detects a pressure pattern in the combustion chamber of the cylinder. Furthermore, provision is made for an exhaust gas probe 72, which is arranged upstream of the exhaust gas catalytic converter 48 and which detects the remainder oxygen content of the exhaust gas and whose measuring signal is characteristic of the air/fuel ratio in the combustion chamber 13 of the cylinder Z1.

Depending on the embodiment, there can be any subset of the sensors mentioned or there can even be additional sensors.

The final control elements are, for example, the throttle valve 18, the gas intake valve and the gas exhaust valve 30, 32, the phase adjusting devices 38, 40, the charge movement flap, the injection valve 44 or the spark plug 46.

In addition to the cylinder Z1, corresponding final control elements and sensors are also been allocated to the additional cylinders Z2, Z3, Z4 of the internal combustion engine and controlled accordingly.

The control device 52 corresponds to a device for controlling an internal combustion engine.

Figure 2:
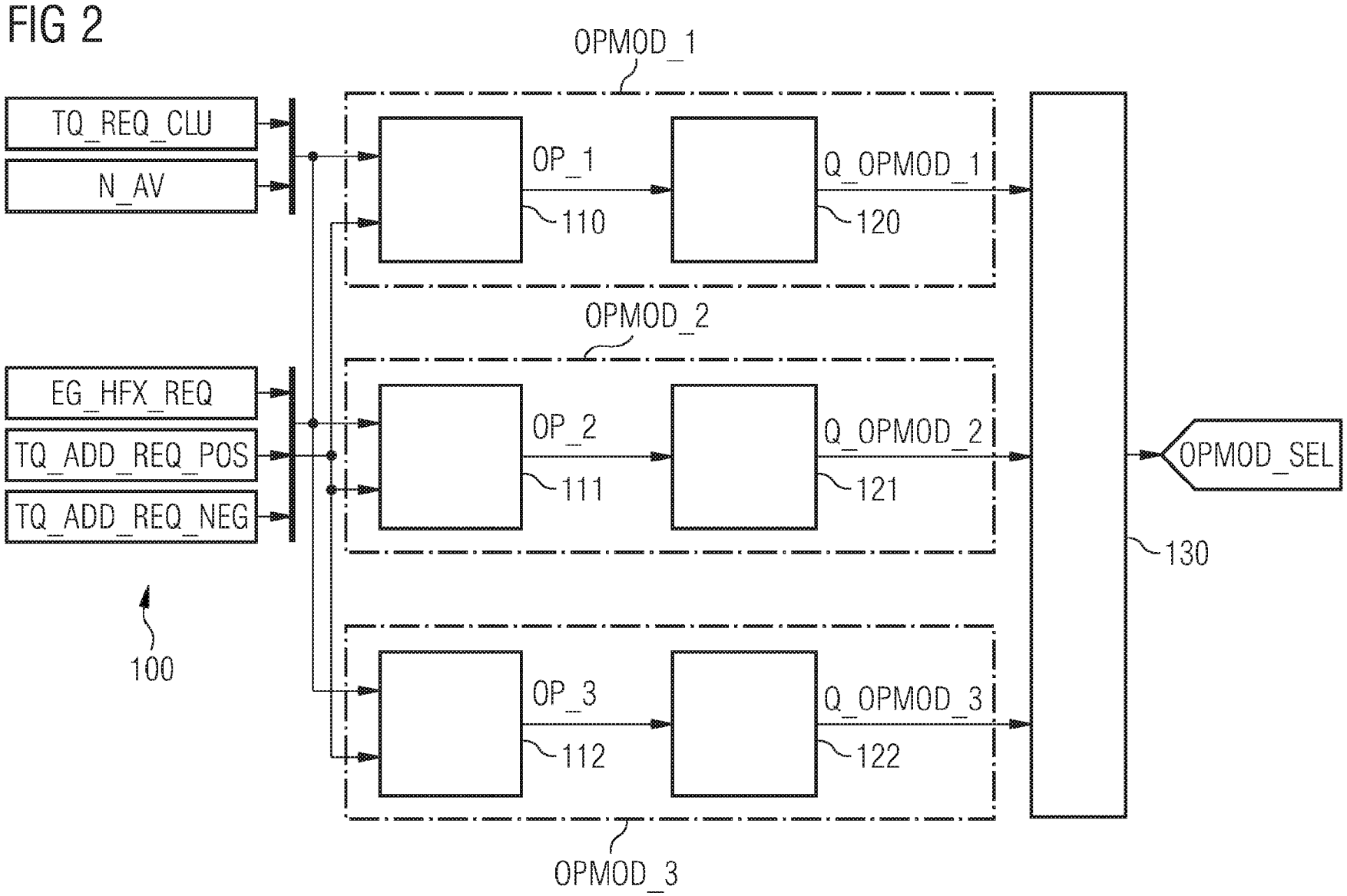
FIG. 2 a block diagram of an embodiment of a method for controlling an internal combustion engine for the selection of a mode of operation, FIG. 3 a block diagram of a first program, which is processes in the device for controlling an internal combustion engine, FIG. 4 a block diagram of a further program, which is processed in the device for controlling an internal combustion engine, FIG. 5 a block diagram of a further program, which is processed in the device for controlling an internal combustion engine, FIG. 6 a block diagram of a further embodiment of a method for controlling an internal combustion engine and FIG. 7 a detailed representation from the block diagram of FIG. 6.

FIG. 2 depicts a block diagram for the control method of an internal combustion engine. The method is to be described here exemplarily on the basis of three modes of operation OPMOD_1, OPMOD_2 and OPMOD_3. It is however to be understood that the method for the controlling of an internal combustion engine can be accomplished with any number of modes of operation, provided at least two modes of operation are involved. A first mode of operation can be for example a homogeneous operation of a direct fuel injection during the intake phase, a second one a shift operation during the compression phase and a third one a mixed mode operation of the homogenous operation and the shift operation. Further modes of operation are for example homogenous operation and shift operation combined with different injection options such as single injection or multiple injection.

From the operating variables 100, first in blocks for operating point computation 110, 111, 112 for each mode of operation an operating point OP_1, OP_2, OP_3 with setpoint variables is calculated in each case. The operating points OP_1, OP_2, OP_3 will in each case be supplied in further blocks for operating point evaluation 120, 121, 122, in which the operating mode quality values Q_OPMOD_1, Q_OPMOD_2, Q_OPMOD_3 are determined in each case. In a block operating selection 130, a selected mode of operation OPMOD_SEL is then determined. Depending on the operating variables 100 of the selected mode of operation OPMOD_SEL, relevant correcting variables are determined and set.

The method for controlling an internal combustion engine does not have to be carried out in each case for all three modes of operation OPMOD_1, OPMOD_2, OPMOD_3. It can already be sufficient if at least two modes of operation are used for the method for controlling an internal combustion engine and for these, the method for controlling an internal combustion engine is carried out.

As the operating variables 100, in this exemplary embodiment, a clutch torque requirement TQ_REQ_CLU, a number of revolutions actual value N_AV, a positive torque lead requirement TQ_ADD_REQ_POS, a negative torque lead requirement TQ_ADD_REQ_NEG and an exhaust gas heating flow requirement IG_HFX_REQ are used. The method is also however applicable to a subset of these operating variables or to further operating variables not represented here.

Figure 3:
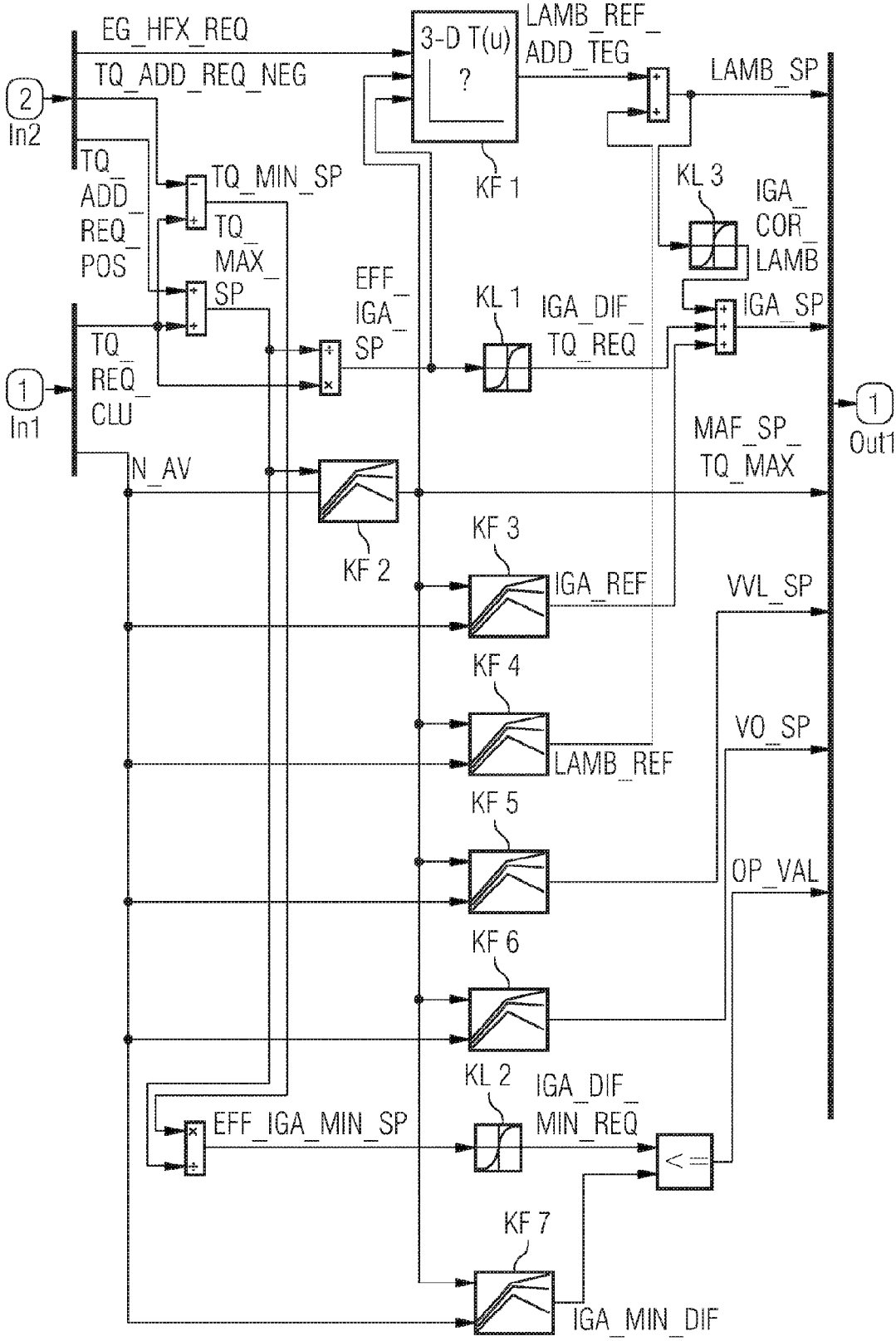
Figure 4:
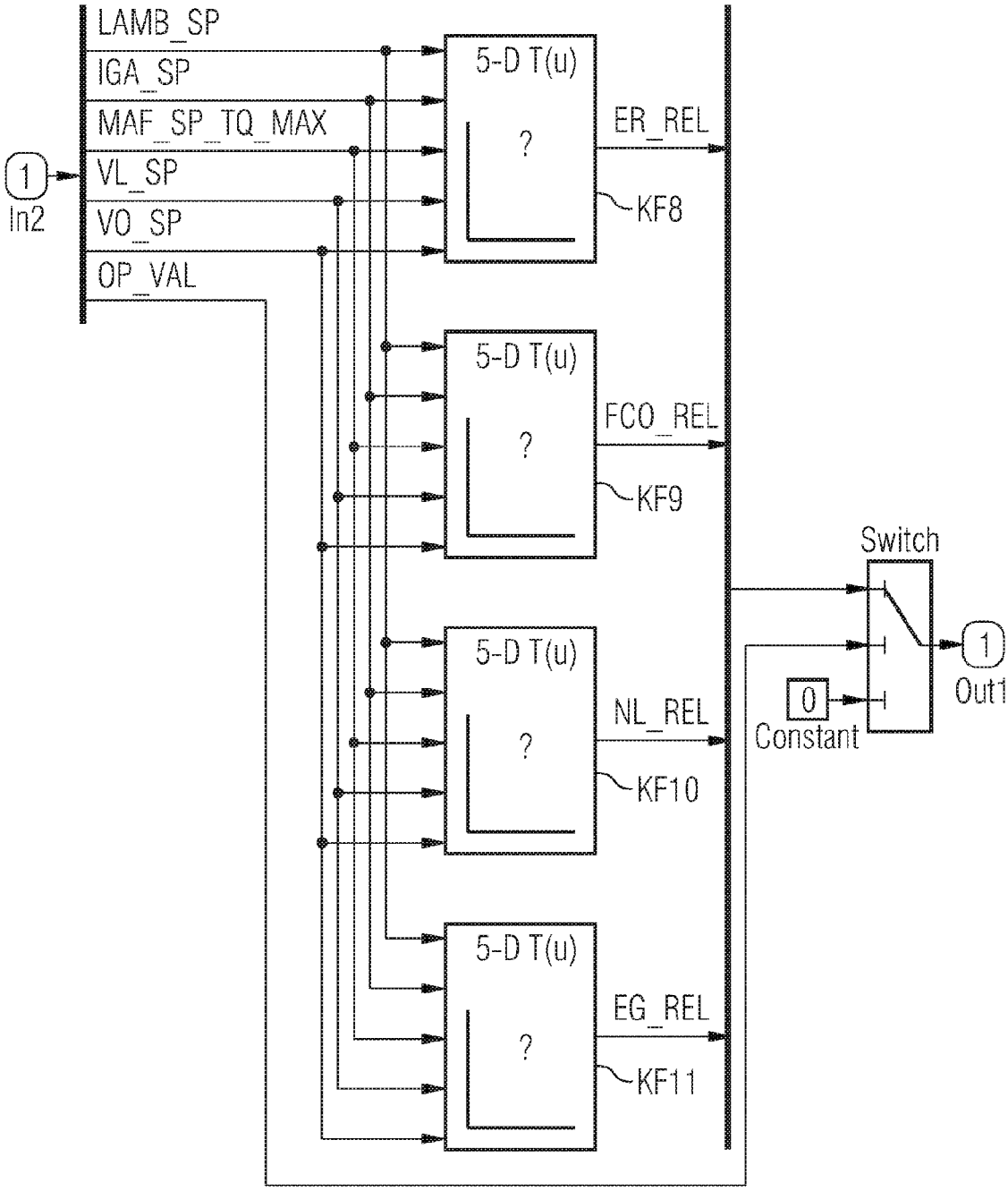
Figure 5:
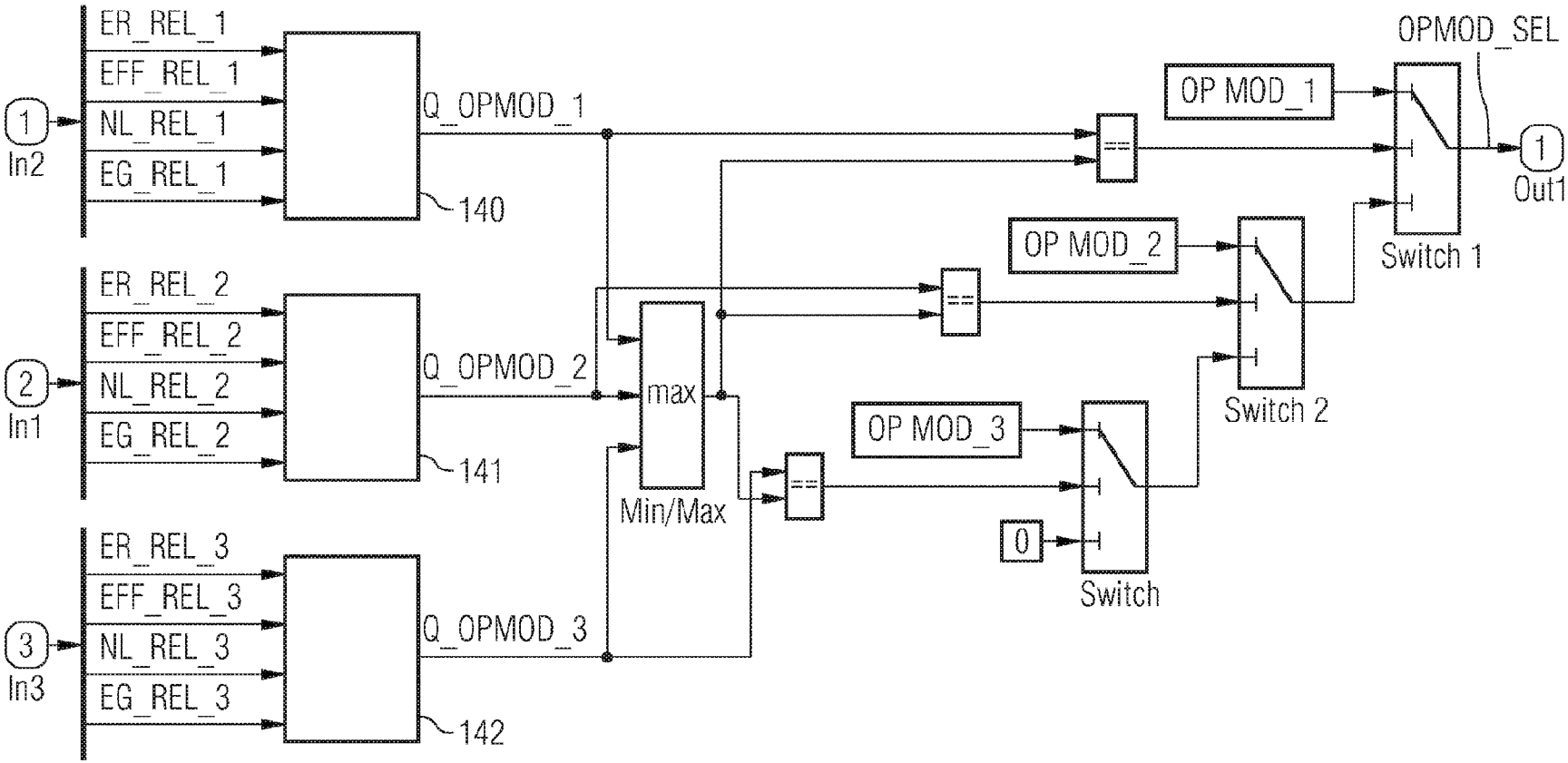

In FIGS. 3 to 5, the method for controlling an internal combustion engine, as depicted in FIG. 2, is shown in further detail on the basis of an exemplary embodiment.

FIG. 3 shows the operating point computation for a mode of operation according to one of the blocks 110, 111, 112 of the FIG. 2. The clutch torque requirement TQ_REQ_CLU is added together with the positive torque lead requirement TQ_ADD_REQ_POS to a maximally implementable torque TQ_MAX_SP. In addition, the clutch torque requirement TQ_REQ_CLU together with the negative torque lead requirement TQ_ADD_REQ_NEG is combined with a minimally implementable torque TQ_MIN_SP. The torque TQ_MAX_SP that can maximally be represented is supplied together with the number of revolutions actual value N_AV to a characteristic diagram KF2, by means of which a filling setpoint value MAF_SP_TQ_MAX can be determined. The filling setpoint value MAF_SP TQ_MAX is the setpoint value, which results for the filling in the case of otherwise optimally set parameters. The filling setpoint value MAF_SP_TQ_MAX is now supplied together with the number of revolutions actual value N_AV to a characteristic diagram KF3 and with this an ignition angle reference value IGA_REF is determined. In addition, the filling setpoint value MAF_SP_TQ_MAX is supplied together with the number of revolutions actual value N_AV to a characteristic diagram KF4 and by means of this an air/fuel ratio reference value LAMB_REF is determined. In addition, a valve lift setpoint value VVL_SP is determined from the filling setpoint value MAF_SP_TQ_MAX together with the number of revolutions actual value N_AV via a characteristic diagram KF5. Likewise from the two variables, filling setpoint value MAF_SP_TQ_MAX and number of revolutions actual value N_AV, an overlapping setpoint value VO_SP is determined by means of a characteristic diagram KF6. Via a characteristic diagram KF7 with the input variables of the number of revolutions actual value N_AV and the filling setpoint value MAF_SP_TQ_MAX, an ignition angle retardation maximum value IGA_MIN_DIF is determined up to the minimum ignition angle at this operating point. By division of the minimally implementable torque TQ_MIN_SP by the maximally implementable torque TQ_MAX_SP, a minimally implementable efficiency correction of the minimum ignition angle efficiency correction setpoint value EFF_IGA_MIN_SP is determined. Via a characteristic KL2, the ignition angle retardation results from this one requirement IGA_DIF_MIN_REQ based on the minimum efficiency correction. If the requirement IGA_DIF_MIN_REQ of the ignition angle retardation based on the minimum efficiency correction is smaller than or equal to the ignition angle retardation maximum value IGA_MIN_DIF, then the operating point is implementable in the mode of operation and an operating point validity value OP_VAL is set equal to 1. If the requirement IGA_DIF_MIN_REQ of the ignition angle retardation based on the minimum efficiency correction is greater then the ignition angle retardation maximum value IGA_MIN_DIF, then the condition of the negative torque lead requirement cannot be fulfilled and the operating point is not implementable in the mode of operation. The operating point validity value OP_VAL is the set equal to zero. From the clutch torque requirement TQ_REQ_CLU and the maximally implementable torque TQ_MAX_SP, an ignition angle efficiency correction setpoint value EFF_IGA_SP is determined. This value is then together with the filling setpoint value MAF_SP_TQ_MAX and the exhaust gas heating flow requirement EG_HFX_REQ supplied to a characteristic diagram KF1. For this reason, an air/fuel ratio correction reference value LAMB_REF_ADD_TEG can be determined. The air/fuel ratio correction reference value LAMB_REF_ADD_TEG is added to the air/fuel ratio reference value LAMB_REF resulting in an air/fuel ratio setpoint value LAMB_SP. From the ignition angle efficiency correction setpoint value EFF_IGA_SP, a value for the ignition angle retardation requirement IGA_DIF_TQ_REQ can be determined by means of a characteristic KL1. In addition, an air/fuel ratio ignition angle correction IGA_COR_LAMB is determined from the air/fuel ratio setpoint value LAMB_SP via a characteristic KL3. These together with the value for the ignition angle retardation requirement IGA_DIF_TQ_REQ and the ignition angle reference value IGA_REF form an ignition angle setpoint value IGA_SP by summation.

The air/fuel ratio setpoint value LAMB_SP, the ignition angle setpoint value IGA_SP, the filling setpoint value MAF_SP_TQ_MAX, the valve lift setpoint value VVL_SP, the overlapping setpoint value VO_SP and the operating point validity OP_VAL together form the setpoint variables of the example shown here.

Going beyond the represented example, further setpoint variables can naturally be determined, as far as this is necessary for the method for controlling an internal combustion engine. In particular, a camshaft phasing setpoint value CAM_PHA_SP, an injection phasing setpoint value INJ_PHA_SP, a charge movement flap position setpoint value PORT-SP, an exhaust gas recirculating rate setpoint value EGR_SP and a cylinder masking setpoint value CYL_FDOUT_SP can be selected. It is to be understood that also subsets from the mentioned group of the setpoint variables can be used for the method for controlling an internal combustion engine.

In FIG. 4, the determination of partial operating mode quality values from the setpoint variables is represented. The setpoint variables air/fuel ratio setpoint value LAMB_SP, ignition angle setpoint value IGA_SP, filling setpoint value MAF_SP_TQ_MAX, valve lift setpoint value VVL_SP and the overlapping setpoint value VO_SP are in each case supplied to the characteristic diagrams KF8, KF9, KF10 and KF11 in order to determine for this reason partial operating mode quality values. The partial operating mode quality values are relative variables, which are related to a reference value in each case, which accepts an optimum value preferentially related to the setpoint variables of an optimum value. By means of the characteristic diagram KF8, a relative uneven running ER_REL, by means of the characteristic diagram KF9 a relative fuel consumption FCO_REL, by means of the characteristic diagram KF10 a relative noise level NL_REL and by means of the characteristic diagram KF11 a relative exhaust gas emission EG_REL is determined.

In a further embodiment, the determination of the partial operating mode quality values by means of using neuronal networks instead of or in combination with the characteristic diagrams. Neuronal networks can be highly efficient for the determination of partial operating mode quality values.

The four partial operating mode quality values ER_REL, FCO_REL, NL_REL, EG_REL are handed as input variables to the respective cost functions for the operating points 140, 141, 142, if the appropriate operating point validity value OP_VAL takes the value 1 (FIG. 5). The operating mode quality values Q_OPMOD_1, Q_OPMOD_2 and Q_OPMOD_3 are now determined by means of the cost functions 140, 141, 142. From the maximum value of the operating mode quality values Q_OPMOD_1, Q_OPMOD_2, Q_OPMOD_3 it finally results which of the three modes of operation OPMOD_1, OPMOD_2, OPMOD_3 is specified as the selected mode of operation OPMOD_SEL. The mode of operation OPMOD_SEL selected depending on the operating mode quality values is thus determined with due consideration of preferably a number of relevant requirements affecting the operating point.

In order to avoid too frequent shifting methods between the modes of operation, a wait loop or a hysteresis function are used in this case. This enables the number of procedures for switching between the modes of operation to be reduced and in this way the temporal mode of operation method can be smoothed.

Figure 6:
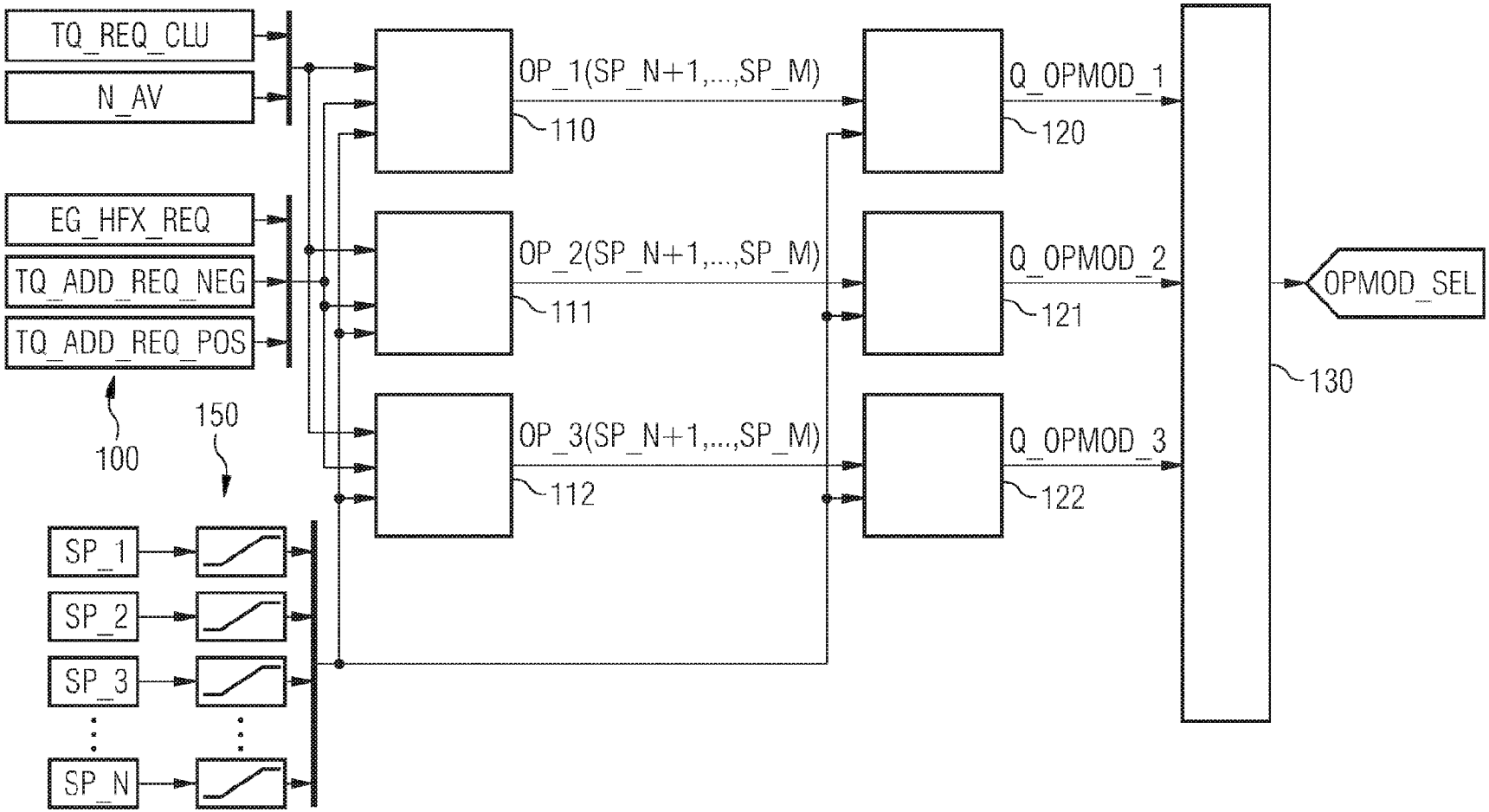

FIG. 6 shows a further embodiment of the method for controlling an internal combustion engine. In the top of the figure, the method for controlling an internal combustion engine, as is known from FIG. 2, is represented. In addition, first setpoint variables SP_1-SP_N are shown, which in each case follow a ramp function 150 and which are supplied to the blocks for operating point computation 110, 111, 112 and the blocks for operating point evaluation 120, 121, 122.

Figure 7:
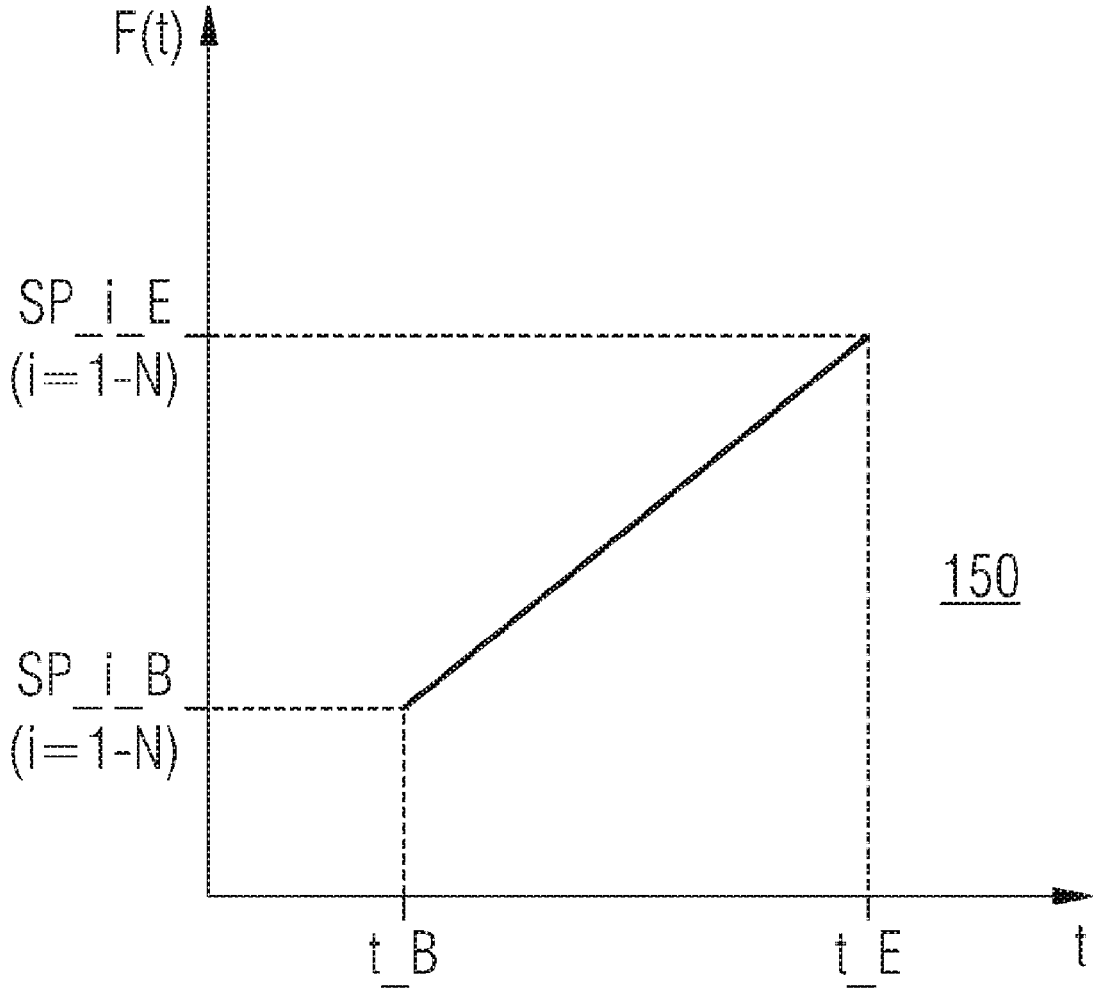

Such a ramp function 150 is shown in detail in FIG. 7. On the basis of the first initial setpoint variables SP_1_B-SP_N_B to a start time t_B, the first setpoint variables SP_1-SP_N of a time-dependent function F(t) follow, in order to finally reach the first end setpoint variables SP_1_E-SP_N_E at the end time t_E. In the example represented in FIG. 7, the time-dependent function F(t) depends linear on the time.

However, the function F(t) can in principle accept any desired functional method between the start time t_B and the end time t_E.

The first setpoint variables SP_1-SP_N, are setpoint variables, whose dynamic behavior is relatively slow and which can be characterized with a low-pass behavior. The dynamic behavior of variables is referred to as slow in this connection, if their time constant lies in the range of several 100 ms and for this reason around a factor 10 to over 100 over the time constant of a cylinder segment, i.e. is appropriate for the time of an operating period of the internal combustion engine divided by the number of the cylinders. According to the determination of new operating variables 100, the first initial setpoint variables SP_1_B-SP_N_B according to the first setpoint variables as initial values and the first final setpoint variables SP_1_E-SP_N_E are specified valid to the start time t_B depending on the new operating variables 100 as target variables.

Between the time t_B and the time t_E, an operating point computation and an operating point evaluation takes place at each point in time depending on the method of the function F(t). The comparison of the operating mode quality values Q_OPMOD_1, Q_OPMOD_2 and Q_OPMOD_3 determined thereby results in a selected mode of operation OPMOD_SEL, as has already been explained in the above-mentioned on the basis of FIGS. 2 to 5 above.

The temporal change in the first setpoint variables SP_1-SP_N with a slow responding mode is the mode of operation selected by superordinate priority regarding the transition between the current mode of operation and OPMOD_SEL. This means that the functional method of the first setpoint variables SP_1-SP_N in the time between the start time t_B and the end time t_E is not influencable, as long as no new operating variables 100 are determined. In the time the mode of operation OPMOD_SEL determined between the start time t_B and the end time t_E, second setpoint variables SP_N+1-SP_M are made available as degrees of freedom, which do not have a common intersection with the group of the first setpoint variables SP_1-SP_N. In this method, the group of the second setpoint variables SP_N+1-SP_M thereby comprises all the setpoint variables with fast dynamic behavior, i.e. a change in the second setpoint variables SP_N+1-SP_M is final within an operating period of the internal combustion engine. These second setpoint variables SP_N+1-SP_M for example include the ignition angle and the injection phasing.

What is claimed is:

1. A method for controlling an internal combustion engine having at least one cylinder, in which a combustion chamber is embodied into which fuel is injected in at least two modes of operation, with the following steps:

a) calculating an operating mode quality value for each of at least two modes of operation, wherein calculating an operating mode quality value for each mode of operation includes:

determining a plurality of setpoint variables based on a plurality of operating variables, the operating variables comprising measured variable or variables derived therefrom, wherein, for the purposes of calculating the operating mode quality value, at least one of the setpoint variables is defined by a predetermined time-dependent function over time from an initial setpoint variable at a start time up to a final setpoint variable at an end time, calculating an operating point based on the determined setpoint variables, and calculating the operating mode quality value based on the calculated operating point, b) depending on the operating mode quality values determined for each of the at least two modes of operation, selecting a mode of operation from the at least two modes of operation, and c) determining and setting correcting variables depending on the at least one operating variable and the selected mode of operation, wherein the selection of the mode of operation occurs only if a minimum amount of a change in the operating mode quality value has occurred since a previous mode of operation selection.

2. The method according to claim 1, wherein, the given time-dependent function is linearly time-dependent.

3. The method according to claim 1, wherein, the setpoint variables are selected from the group consisting of a rotational speed setpoint value, a fresh gas mass flow setpoint value, an ignition angle setpoint value, a camshaft phasing setpoint value, an injection phasing setpoint value, an air/fuel ratio setpoint value, a valve lift setpoint value, an overlapping setpoint value VO_SP, a charge movement flap position setpoint value, an exhaust gas recirculating rate setpoint value and a cylinder masking setpoint value.

4. The method according to claim 1, wherein, a determinationm of the partial operating mode quality values are selected from the group consisting of a relative fuel consumption, a relative engine noise, a relative dynamic behavior, a relative exhaust gas emission and a relative noise level.

5. The method according to claim 1, wherein, a determination of the partial operating mode quality values takes place depending on the setpoint variables by means of using characteristic diagrams.

6. The method according to claim 1, wherein, a determination of the partial operating mode quality values takes place depending on the setpoint variables by means of using neuronal networks.

7. The method according to claim 1, wherein, a change in the mode of operation is only permitted within given time intervals.

8. The method according to claim 1, wherein, the selection of the mode of operation takes place depending on a minimum amount of a change in the operating mode quality value since a preceding selection of the mode of operation, so that the number of steps is limited to the selection of the mode of operation in a fixed period.

9. A device for controlling an internal combustion engine comprising at least one cylinder, in which a combustion chamber is formed, into which fuel is injected in at least two modes of operation, wherein the device is operable to a) calculate an operating mode quality value for each of at least two modes of operation, wherein calculating an operating mode quality value for each mode of operation includes:

determining a plurality of setpoint variables based on a plurality of operating variables, the operating variables comprising measured variable or variables derived therefrom, wherein, for the purposes of calculating the operating mode quality value, at least one of the setpoint variables is defined by a predetermined time-dependent function over time from an initial setpoint variable at a start time up to a final setpoint variable at an end time, calculating an operating point based on the determined setpoint variables, and calculating the operating mode quality value based on the calculated operating point, b) select a mode of operation from the at least two modes of operation depending on the operating mode quality values determined for each of the at least two modes of operation, and to c) determine and set correcting variables depending on the at least one operating variable and the selected mode of operation, wherein the selection of the mode of operation occurs only if a minimum amount of a change in the operating mode quality value has occurred since a previous mode of operation selection.

10. The device according to claim 9, wherein, the given time-dependent function is linearly time-dependent.

11. The device according to claim 9, wherein, the setpoint variables are selected from the group consisting of a rotational speed setpoint value, a fresh gas mass flow setpoint value, an ignition angle setpoint value, a camshaft phasing setpoint value, an injection phasing setpoint value, an air/fuel ratio setpoint value, a valve lift setpoint value, an overlapping setpoint value VO_SP, a charge movement flap position setpoint value, an exhaust gas recirculating rate setpoint value and a cylinder masking setpoint value.

12. The device according to claim 9, wherein, a determination of the partial operating mode quality values are selected from the group consisting of a relative fuel consumption, a relative engine noise, a relative dynamic behavior, a relative exhaust gas emission and a relative noise level.

13. The device according to claim 9, wherein, a determination of the partial operating mode quality values takes place depending on the setpoint variables by means of using characteristic diagrams.

14. The device according to claim 9, wherein, a determination of the partial operating mode quality values takes place depending on the setpoint variables by means of using neuronal networks.

15. The device according to claim 9, wherein, a change in the mode of operation is only permitted within given time intervals.

16. The device according to claim 9, wherein, the selection of the mode of operation takes place depending on a minimum amount of a change in the operating mode quality value since a preceding selection of the mode of operation, so that the number of steps is limited to the selection of the mode of operation in a fixed period.

* * * * *